US006148582A

United States Patent [19]

Ellingson

[11] Patent Number: 6,148,582

[45] **Date of Patent: *Nov. 21, 2000**

[54] DOORJAMB ASSEMBLY WITH EXTRUDED UNITARY MOLDING AND STOP MEMBERS

[76] Inventor: Robert T. Ellingson, P.O. Box 2299, Covington, Ga. 30209

[ * ] Notice: This patent is subject to a terminal disclaimer.

[21] Appl. No.: 09/046,961

[22] Filed: Mar. 24, 1998

Related U.S. Application Data

[63] Continuation-in-part of application No. 08/865,373, May 29, 1997, Pat. No. 5,901,510, which is a continuation-in-part of application No. 08/549,056, Oct. 27, 1995, Pat. No. 5,634,303.

[51] Int. Cl.[7] ..... E04C 2/38

[52] U.S. Cl. ..... 52/656.4; 52/170; 52/204.53; 52/204.7; 52/210

[58] Field of Search ..... 52/210, 212, 211, 52/204.51, 204.53, 204.1, 204.7, 656.4, 170, 656.2, 204.66, 515; 49/504, 505, DIG. 2

[56] References Cited

U.S. PATENT DOCUMENTS

| | | | |
|---|---|---|---|
| 2,562,105 | 7/1951 | Lang . | |
| 2,736,930 | 3/1956 | Longley . | |
| 3,119,156 | 1/1964 | Salter, Jr. . | |
| 3,245,124 | 4/1966 | Faske . | |
| 3,402,520 | 9/1968 | Lee et al. . | |
| 3,570,202 | 3/1971 | Castellano . | |
| 3,729,870 | 5/1973 | Kvalheim et al. . | |
| 4,040,390 | 8/1977 | Carlton . | |
| 4,281,481 | 8/1981 | Wendt . | |
| 4,430,830 | 2/1984 | Sailor . | |
| 4,492,063 | 1/1985 | Schock et al. . | |
| 4,505,080 | 3/1985 | Sailor . | |
| 4,589,229 | 5/1986 | Warren . | |
| 4,720,951 | 1/1988 | Thorn et al. . | |
| 5,058,323 | 10/1991 | Gerritsen . | |
| 5,182,880 | 2/1993 | Berge, Jr. et al. . | |
| 5,634,303 | 6/1997 | Ellingson | 52/210 |
| 5,661,943 | 9/1997 | Hagel | 52/656.4 |
| 5,873,209 | 2/1999 | Hagel | 52/656.4 |

*Primary Examiner*—Carl D. Friedman
*Assistant Examiner*—Yvonne M. Horton
*Attorney, Agent, or Firm*—Womble Carlyle Sandridge & Rice, PLLC

[57] ABSTRACT

An improved door jamb and brickmold assembly is provided wherein an extruded thermoplastic molding and stop member is secured to wooden support members to define the door jambs and mullions of a door and jamb assembly. The co-extruded plastic molding and stop members define both the stops of the assembly and the exposed decorative molding portion and also protect the wooden support members from exposure to the elements.

17 Claims, 7 Drawing Sheets

DOORJAMB ASSEMBLY WITH EXTRUDED UNITARY MOLDING AND STOP MEMBERS

REFERENCE TO RELATED APPLICATION

This application is a continuation-in-part of U.S. patent application Ser. No. 08/865,373 filed May 29, 1997, now U.S. Pat. No. 5,901,510, which, in turn, is a continuation-in-part of patent application Ser. No. 08/549,056 filed Oct. 27, 1995, now U.S. Pat. No. 5,634,303.

FIELD OF THE INVENTION

This invention relates generally to door or window jamb assemblies used to frame openings in the walls of buildings for receiving doors and windows. More specifically, the invention relates to an improved door jamb assembly wherein elements of the assembly, including the stop, brickmold, and bottom portion of the jamb member are formed from substantially solid extruded thermoplastic material.

BACKGROUND OF THE INVENTION

In constructing a building such as a house, it is common that openings for receiving doors and windows are first roughly framed in with wall studs, which usually are made of wood. Subsequently, the rough framed openings are finished with a wooden door or window jamb assembly, which often is provided with a decorative brickmold that abuts the brick or siding on the outside of the building. In some instances, the brickmold is milled as an integral part of the jamb frame members and in other instances the brickmold is nailed or stapled to the jamb members along their outside edges. In door jamb assemblies in particular, a peripheral lip or stop usually is milled into the wooden support members of the jamb and the stop extends around the inner periphery of the jamb. In use, a closed door mounted to the jamb assembly rests against the stop. In many instances, the stop bears a weather strip that seals against the closed door to prevent drafts.

In sidelight door jamb assemblies, a pair of spaced vertical mullions extend between the sill and the header of the assembly to form a central opening for receiving a hinged door and a pair of narrow side openings on either side of the door for receiving sidelight windows. Such mullions typically are formed of a pair of back-to-back wooden supports that have been milled along their exposed faces to provide stops for abutting a closed door or receiving and securing the sidelight windows. A strip of decorative molding is commonly nailed along the outside edges of the mullion supports to cover their outside edges, to cover the junction between the supports, and to lend a pleasing appearance to the jamb assembly.

A traditional method of fabricating a door jamb assembly is to mill the peripheral support members of the assembly from larger pieces of a high quality clear wood. In this process, a relatively wide thick piece of wood for each leg of the assembly is passed through a milling machine and unwanted portions are cut or milled away and discarded as sawdust. The milling process produces the raised inside peripheral stops and other structural features of the support members. Obviously, this process is wasteful and is becoming more and more expensive in light of the ever-increasing cost of lumber. In some instances, the entire cross-section of each frame member, including the brickmold, is milled as a unitary piece from a wide thick piece of lumber. In other instances, the frame members are milled from two pieces of wood that fit together to define the finished jamb shape. The inner peripheral supports may be milled from relatively thinner pieces of wood to define the frame and door stop and the brickmold may be nailed along the outer edges of the supports to define the finished shape of the jamb. In either case, significant amounts of expensive lumber are required as is time consuming, expensive, and wasteful machining steps. All of this adds to the final cost of traditional door jamb assemblies. Further, and perhaps even more pertinent, is the fact that the exposed wooden brickmold and the molding along the mullions of side light door jamb assemblies requires periodic painting and maintenance in order to prevent rotting as a result of exposure to the weather. Even with the most careful maintenance, these exposed wooden portions of door jamb assemblies can, over time, begin to rot from within whereupon the entire door jamb assembly usually must be replaced. Rot due to moisture can be a particular problem at the bottom ends of the vertical jamb members where they meet and are secured to a door sill assembly. Rain water that runs down onto the door sill assembly tends to be wicked into the bottoms of the vertical jambs causing subsequent rot of the wooden material of the jambs.

Door and window jamb assemblies have been developed that are wholly or partially comprised of extruded thermoplastic portions. For example, U.S. Pat. No. 4,430,830 to Sailor teaches a jamb for mounting a window or door in an opening of an existing structure. The jamb includes an extruded plastic or metal outer frame comprising the stop, a wooden inner frame or jamb for support of the extruded outer frame, fasteners for attaching the outer frame at the window or door opening, and a molded cover that secures the outer frame and conceals the fasteners attaching the frame to the structure. In Sailor, the portion of the plastic outer frame forming the stop and brickmold are hollow and thus may not provide sufficient strength to the frame. The hollow nature of the brickmold makes it unsuitable for receiving standard nails that hold the assembly to the frame. Non-carpentry standard fastening means are thus employed, which is distasteful to many carpenters. In addition, this jamb assembly requires the use of an auxiliary cover to conceal the fasteners attaching the frame to the building structure.

U.S. Pat. No. 5,058,323 to Gerritsen teaches a jamb cladding and brickmold assembly that provides a plastic member that either wraps around a wooden jamb with a milled stop or that wraps around a wooden jamb and provides its own plastic stop. An attachable brickmold is also included. This assembly, like that taught by Sailor, has hollow portions unsuitable for holding nails and liable to be punctured or otherwise deformed by heavy use or forcible contact. U.S. Pat. No. 5,182,880 to Berge, Jr., et al., teaches a cladding and brickmold apparatus similar to that taught by Gerritsen in that it wraps around a combination wooden jamb and stop. Thus, this device requires the use of a wooden jamb with stop and requires that the wood be milled to form the stop. The prior art does not teach a unitary stop and brickmold assembly made of substantially solid extruded thermoplastic material.

U.S. Pat. No. 5,661,943 of Hagel discloses a milled wooden door frame assembly wherein the bottom sections of the vertical jambs are formed from a composite material made of wood particulate that is mixed with resins. These bottom sections are milled or otherwise formed to have the same profile as the wooden portions of the vertical jambs and are joined to the wooden portions with finger joints. The goal of this jamb structure is to address the problem of rot and decay at the bottoms of the vertical jambs where the jambs meet the door sill. While the Hagel frame is an improvement over traditional all wooden door frames, it nevertheless has its own inherent problems and shortcomings. For example, The finger joint that joins the composite bottom sections of the vertical jambs to the upper portions of the jambs tends to be relatively weak, and can be broken off, especially prior to the attachment of brickmold after installation of the frame. In addition, the vertical jambs and head jamb must still be milled to define the finished profile of the frame after the composite bottom portions of the vertical jambs are joined. Obviously, this is an expensive, wasteful, and time consuming task.

SUMMARY OF THE INVENTION

Briefly described, the present invention, in a preferred embodiment thereof, comprises a door jamb assembly having a substantially flat peripheral inner frame preferably formed of wood. Each section of the frame is provided with a unitary brickmold and stop member formed from substantially solid extruded thermoplastic material. In the preferred embodiment, the peripheral inner frame is formed from relatively thin flat wooden boards to provide a traditional looking surface and to provide a solid material for receiving nails and screws when mounting the jamb and hanging a door from the jamb. The brickmold and stop members are extruded from appropriate thermoplastic material to have a cross-sectional configuration that forms both the stop of the jamb assembly and the brickmold that frames the assembly on the outside of a building structure. More particularly, the brickmold and stop members are formed with a leg that at least partially overlies the inside faces of the frame members and that defines a raised inner peripheral stop against which a closed door rests. The brickmold and stop members are also formed to define a decorative brickmold portion that frames the jamb on the outside of the building in which the jamb is installed. The extruded brickmold and stop members are adhered or otherwise firmly mounted to the wooden frame members so that together they form a traditional looking door jamb and brickmold assembly.

The brickmold and stop members are co-extruded from a thermoplastic material and preferably have a relatively less dense blown thermoplastic core covered by a relatively more dense plastic outer skin or covering. The density of the blown core is sufficient to receive and hold a traditional finishing nail so that the assembly can be nailed in place through the brickmold in the traditional way. In one embodiment, the brickmold is co-extruded with a relatively hard plastic flange or tab that projects outwardly from the assembly and that is positioned to overlie the outside surface of the building. During installation, the assembly is positioned with the flanges against the outer wall of the building and the assembly and flange are fastened with nails or screws. Brick, lap board, or another exterior finish can then be applied over the flange and abutting the brickmold to result in a traditional looking exterior door molding arrangement. In the preferred embodiment, the extrusion is also formed to define a groove or slot that extends along the stop of the assembly for receiving and holding the mounting tab of a length of weather stripping.

In another embodiment of this invention, the decorative brickmold has an exposed outer surface and an inner surface that is formed to define a recess. A stabilizer member, such as a strip of wood, is disposed in the recess for stabilizing the brickmold and for providing a more secure medium through which attaching nails can extend. A short tab is co-extruded with the brickmold and stop assembly and the tab extends partially over the outside face of the wooden support member. Staples can be driven through the tab and into the wooden support member to attach the brickmold and stop member to the support member. In one embodiment, the inside face of the wooden support member is milled with a recessed dado and the brickmold and stop member is provided with a projection sized to be disposed in the recessed dado. Staples can be driven through the projection and into the wooden support member for attachment of the brickmold and stop member to the support member.

In still another embodiment of the present invention, the mullions of a side light door jamb assembly are each formed from a back-to-back frame or support member. A generally U-shaped extruded thermoplastic molding and stop member is secured to the support members along the outside edges thereof. The legs of the molding and stop member overlie a portion of the exposed faces of the support members and form elongated stops that extend along the length of the mullions intermediate the inside and outside edges thereof. The bight portions of the molding and stop members covers the outside edges of the support members and provides a decorative appearance to the outside exposed portions of the mullions. The stop formed along one side of the mullion abuts a closed door mounted in the door opening of the jamb assembly and the stop along the other side of the mullion provides a surface against which side light windows can be mounted in the assembly. In one embodiment, the exposed faces of the mullion support members are milled with recessed dados extending along their lengths and the extruded molding and stop members are provided with projections that extend into the milled recesses to hold the molding and stop member in place on the mullion support members. Nails or staples can be driven through the projections if desired and into the support members to hold the molding and stop members in place.

In yet another embodiment of the present invention, the vertical jambs of a door frame assembly are formed by flat wooden supports having extruded plastic stop and brickmold assemblies attached along their outside edge portions as described above. In this embodiment, however, the immediate bottom portions of the vertical wooden supports are defined by an extruded thermoplastic attachment that has a relatively less dense blown plastic core covered by a relatively more dense plastic skin. In the preferred embodiment, each attachment is secured to the bottom of its support with a tongue and groove joint and the extruded brickmold and stop member attached to the support spans the joint between the attachment and the wooden portion of the support. As a result, the bottom portions of the vertical jambs where the jambs meet a door sill are all plastic and are thus immune to rot and decay. Further, the relatively weak joint between each vertical wooden support and its plastic bottom section is strengthened and reinforced because the extruded brickmold and stop spans the joint and is fastened both to the wooden portion of the support and to the plastic bottom section. As a result, the assembly is rigid and strong and not subject to being broken during installation.

Thus it is seen that an improved door jamb assembly is now provided wherein the need to mill or otherwise machine the stops, molding, and other portions of the jamb is eliminated. A relatively inexpensive thin flat board is used to form the inner peripheral jamb or frame of the assembly. The stop members and decorative molding portions of the jamb assembly are formed from unitary thermoplastic co-extrusions that look, feel, and hold nails like wood but that require substantially less maintenance than wood and are not subject to rot or deterioration as is wood. The jamb assembly of this invention can be installed with finish nails in the same way as a traditional wooden assembly. This is an advantage to carpenters, who prefer traditional installation methods to new or complex alternate methods. As an added advantage, the bottom sections of the vertical jambs that meet and are attached to a door sill are formed of extruded plastic material that is immune to rot and deterioration. These and many other objects, features, and advantages will become more apparent upon review of the detailed description set forth below taken in conjunction with the accompanying drawings which are briefly described as follows.

DETAILED DESCRIPTION OF THE PREFERRED EMBODIMENTS

Figure 1:
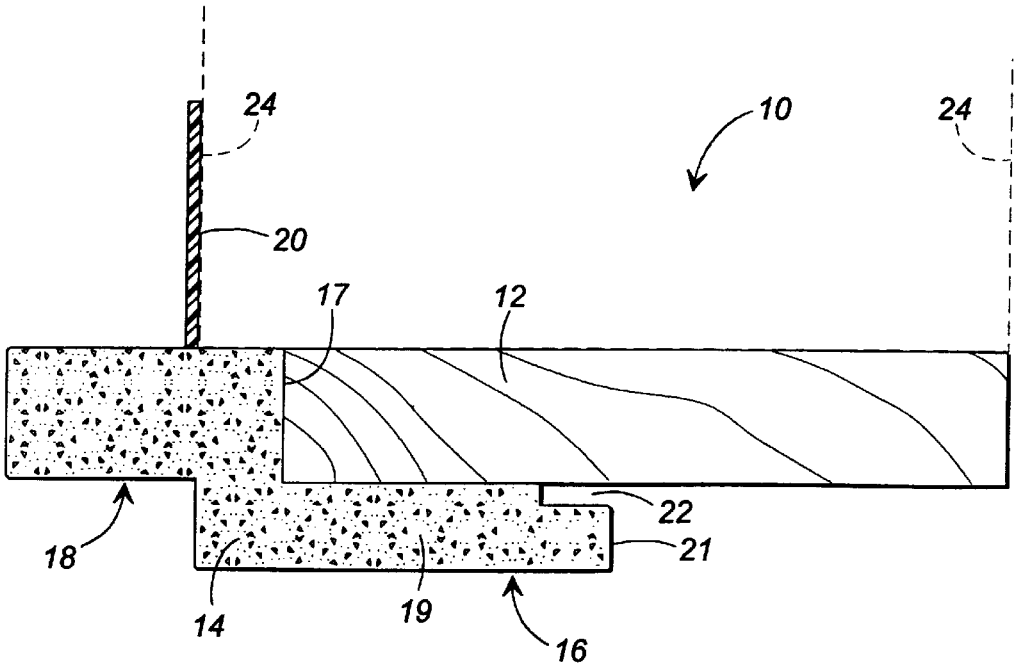
FIG. 1 is a cross-sectional view of a door jamb and brickmold assembly that embodies principles of the present invention in a preferred form.

FIG. 1 is a cross-sectional view of a door jamb and brickmold assembly that embodies principles of the present invention in a preferred form. It will be understood that a complete door jamb assembly comprises three sections fabricated as shown in FIG. 1 secured together to form the vertical jambs and horizontal header of a doorway opening. The portion of the assembly on the right in FIG. 1 resides on the interior of a building in which the assembly is installed and the portion on the left, known as the brickmold, resides on the outside of the building.

The door jamb and brickmold assembly 10 comprises a jamb member 12 in the form of an elongated relatively thin rectangular board. In the preferred embodiment, the jamb 12 is made of a flat wooden board. Such construction provides a traditional appearance on the inside of the building structure and also provides for traditional fastening of the jamb and brickmold assembly to a framed-in opening with nails or screws. However, material other than wood could be used for the jamb member with comparable results. The use of wood for the jamb 12 is not as disadvantageous as the milled wooden door jambs of the prior art. This is because the jamb member in this invention is a simple flat board that does not require any special and expensive machining or milling and that is readily available at reasonable cost and in standard sizes.

A unitary brickmold and stop member 14 is securely fixed with adhesive or other appropriate means along the outer edge portion of the jamb member 12. The brickmold and stop member 14 is formed of a suitable thermoplastic material that has been co-extruded through a plastic extruder head to have the exterior shape and configuration shown in FIG. 1. Preferably, the co-extrusion that forms the member 14 is substantially solid with the interior portion thereof being extruded of a relatively less dense blown thermoplastic material and with the exterior skin being a relatively more dense non-blown thermoplastic material. The interior thermoplastic material is extruded with a blowing agent with proper characteristics to result in a density and consistency sufficient to receive and hold a traditional finishing nail or the like. The exterior skin of the member 14 provides a resilient surface that is resistant to impacts while at the same time provides an excellent surface for receiving primers and paints. Blowing and extruding techniques are well known and any suitable technique and combination of materials may be used in the present invention.

The brickmold and stop member 14 is formed to define a rabbet 17 that is shaped and sized to receive the outside edge portion of the jamb member 12 as shown. The rabbet 17 defines a leg 19 of the member 14 that is nailed or glued to and overlies a portion of the exposed face of the jamb member 12 and extends to approximately the mid-point thereof. The leg 19 terminates in an end portion 21 that extends outwardly from and perpendicular to the face of the jamb member 12. With this configuration, the end portion 21 of the leg 19 forms a raised peripheral stop that extends along the jamb member and around the interior of the jamb assembly. In use, a door mounted to the jamb assembly, when closed, rests against the stop as it would against the milled stop of a prior art all-wooden jamb assembly.

Preferably, the end portion of the leg 19 is also formed with a narrower rabbet 22 that, in conjunction with the face of the jamb member 12, forms a groove or slot that extends around the jamb member at the intersection of the stop and the jamb. The groove formed by the rabbet 22 is sized and shaped to receive the mounting tab of a length of traditional weather stripping material that seals against a closed door resting against the stop 21. Thus, the mounting tab of the weather strip is both concealed and secured firmly to the assembly in the groove formed by the rabbet 22.

The other end of the member 14 is shaped to define a decorative brickmold portion 18. The brickmold portion 18 is sized and shaped to extend outwardly from and generally transversely with respect to the outer edge of the jamb so that it frames the entire door and jamb assembly on the outside of the building to which the assembly is attached. An elongated flap or tab 20 in the embodiment of FIG. 1 is co-extruded with and is an integral part of the brickmold and stop member 14. The tab 20 projects from the member 14 and is formed of a relatively dense rigid plastic material that is adapted to receive and hold nails or screws. The purpose of the tab 20 is to allow the assembly to be mounted within a framed opening of a building, indicated by the numeral 24, with the tab 20 being secured by nails or screws to the framing studs around the exterior of the opening. If desired, a sealant can be applied between the tab 20 and the framing of the building to provide an airtight seal against drafts that might otherwise enter the building between the jamb assembly and the frame. The tab 20 also serves to hold the brickmold and stop member 14 securely in place around the entire periphery of the opening.

Once the assembly is installed with the tab securely fixed, the tab 20 is covered with brick, siding, or other facade as selected by the builder. Such facade abuts against the back edge of the brickmold portion 18 and, in the case of brick, can even extend forwardly on this portion. Thus, the appearance of a traditional milled wooden brickmold is presented.

The door jamb and brickmold assembly illustrated in FIG. 1 can be substantially more economical to produce than traditional all wooden milled jamb assemblies depending, of course, on milling costs and the cost of lumber. Equally as important, the extruded plastic material of the brickmold and stop member is not subject to rot or deterioration as is wood and can, if desired, be colored or tinted so that it does not require painting or other maintenance. In addition, the assembly illustrated in FIG. 1 is far superior to prior art assemblies that attempt to combine extruded plastic portions with wooden portions wherein the plastic portions are hollow or otherwise insufficient for receiving and holding traditional fastening means such as nails or screws. Further, an environmental advantage is provided by this invention in that a single flat board is used for the jamb member 12. This eliminates the need to start with a much thicker and wider board and mill it down in a wasteful process of forming a milled wooden jamb assembly. Accordingly, much less wood is used and wasted, which contributes to conservation of the environment. Finally, the co-extruded brickmold and stop member 14 is rugged, strong, able to receive and hold a nail, and provides all of the advantages of wood with the additional advantage that it is not subject to rot and vermin and has a surface particularly suited to application of primer and paint.

Figure 2:
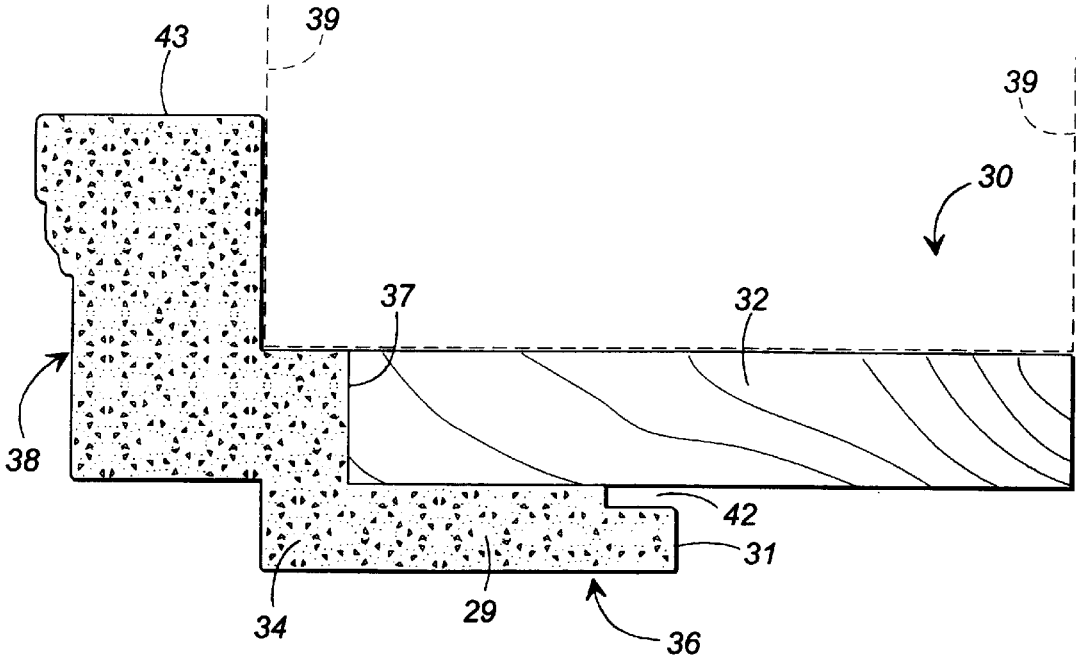
FIG. 2 is a cross-sectional view of a door jamb and brickmold assembly that embodies principles of the present invention in an alternate form.

FIG. 2 illustrates another preferred embodiment of this invention having a second type of decorative brickmold formed by the co-extruded thermoplastic brickmold and stop member. In this embodiment, as in the embodiment of FIG. 1, a rectangular relatively thin wooden jamb member 32 has attached thereto by adhesive or other suitable means a co-extruded thermoplastic brickmold and stop member 34. The brickmold and stop member 34 is formed with a rabbet 37 that receives the end portion of the jamb member 32. The brickmold and stop member defines a leg 29 that overlies a portion of the face of the jamb member 32 and extends to approximately the mid-point thereof. The end portion 31 of the leg 29 forms a raised stop relative to the face of the jamb member for abutting a closed door. A small narrow rabbet 42, in conjunction with the face of the jamb member 32, forms a narrow groove extending along the length of the stop for receiving and holding the mounting tab of a length of weather stripping.

In the embodiment of FIG. 2, the securing tab 20 of FIG. 1 is eliminated and replaced by a decorative brickmold portion that extends outwardly from the jamb assembly and overlies the exterior framing studs 39 of the building in which the assembly is installed. Since the co-extruded brickmold and stop member 34 is formed with a relatively less dense blown core and a relatively more dense outer skin, it is uniquely suited to receive and hold a common finishing nail. Accordingly, such a nail can be driven directly through the brickmold portion 38 of the member 34 and into the stud 39 to secure the front of the jamb in place to the stud. The embodiment of FIG. 2 more closely parallels one traditional decorative design for door jamb and brickmold assemblies. As with the embodiment of FIG. 1, brick, siding, or other facade is secured to the exterior of the building after the jamb has been installed and the facade abuts the end 43 of the brickmold portion in the traditional way.

Figure 3:
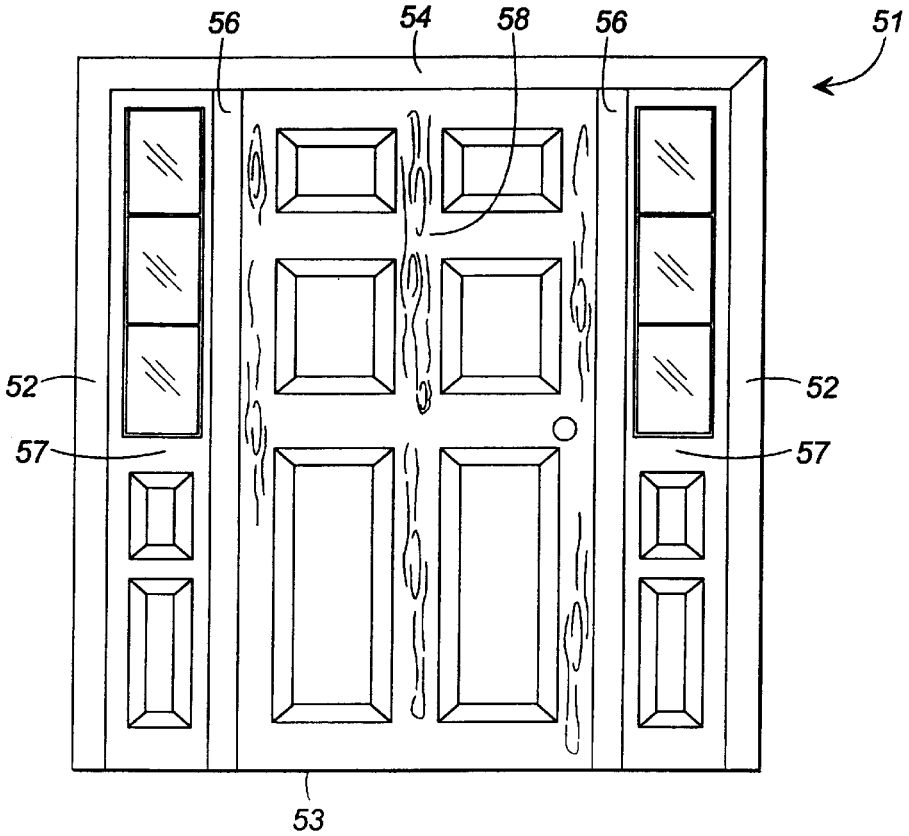
FIG. 3 illustrates the configuration of a typical side light door jamb assembly wherein vertically extending mullions form the door and side light window openings of the assembly.

FIG. 3 illustrates a typical door and door jamb assembly of the type that has a central hinged door 58 and side light window panels 57 that flank the door on either side. The door and jamb assembly of FIG. 3 comprises a pair of vertical jambs 52 that extend between a sill 53 and a header 54. Together, the jambs 52 and 53 and the header 54 define the outer peripheral frame of the door and jamb assembly. A pair of spaced mullions 56 extend vertically between the sill 53 and the header 54 and define a central opening in which the hinged door 58 is disposed and two flanking side openings on either side of the door for receiving the side light window panels 57. Much of the discussion that follows refers to a side light door and door jamb assembly of this type.

Figure 4:
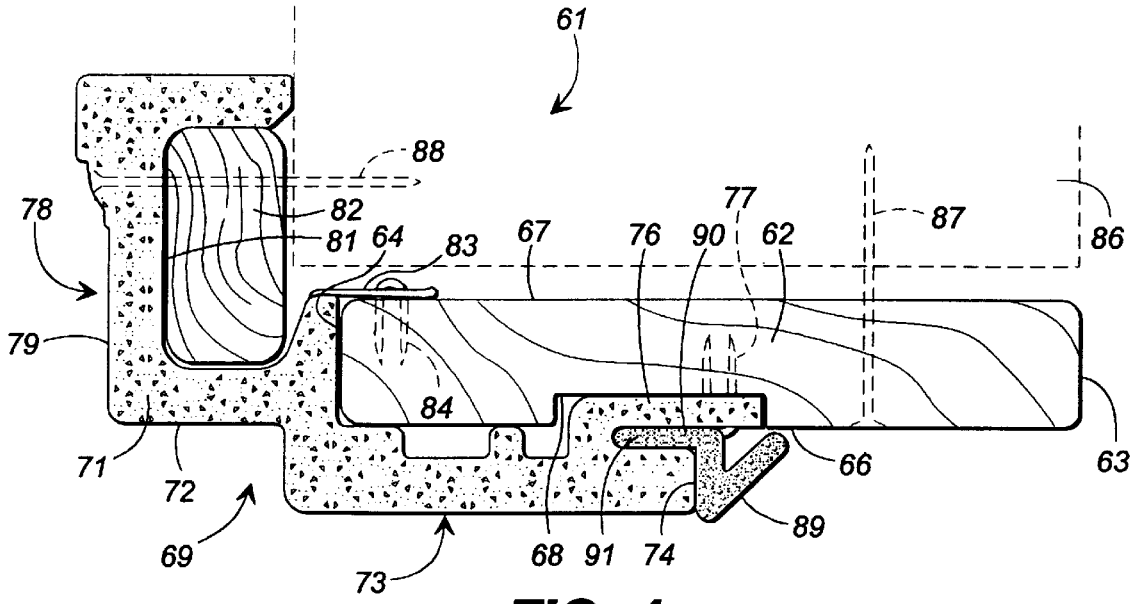
FIG. 4 is a cross-sectional view of a door jamb and brickmold assembly that embodies principles of the present invention in an alternate form.

FIG. 4 illustrates in a cross sectional view a door jamb and brickmold assembly that embodies principles of the present invention in one preferred form. The door jamb and brickmold assembly of FIG. 4 might, for example, embody the configuration of the upstanding jambs 52 and the header 54 of the assembly shown in FIG. 3. Alternately, this configuration might be the vertical jambs and horizontal header of a door assembly that did not contain side light windows.

The assembly 61 comprises a jamb member 62 having an inside edge 63, an outside edge 64, an inside face 66, and an outside face 67. In the preferred embodiment, the jamb member 62 comprises an elongated relatively thin wooden board. However, the jamb member could also be made of other materials such as extruded plastic or particle board. A recessed dado 68 is formed in the outside face 66 of the jamb member 62 and extends along the length thereof.

An extruded thermoplastic brickmold and stop member 69 is mounted to the jamb member 62 and extends generally along the outside edge 64 thereof. The brickmold and stop member 69 preferably is co-extruded through an appropriate plastic extruder head to have a relatively less dense blown plastic core 71 and a relatively more dense plastic skin 72. The assembly 69 is configured to define a leg 73 that overlies a portion of the inside face 66 of the jamb member 62 and that extends approximately to the midsection thereof. The end 74 of the leg 73 defines a raised stop relative to the inside face 66 of the jamb member. The raised stop provides a rim against which a door or side light window panel rests when installed in the jamb assembly.

The leg 73 of the assembly 69 is further formed with a projection 76 that is positioned and configured to be received into the recessed dado 68 formed along the inside face 66 of the jamb member. Preferably, the projection 76 extends beyond the position of the end 74 of the leg 73 to provide a tab through which fasteners such as staples 77 can be driven to attach the projection and thus secure the brickmold and stop member 69 to the jamb member 62. Naturally, fasteners other than the staples illustrated in the preferred embodiment can also be used. For example, the projection might be fastened with nails, adhesive, or any other appropriate means of fastening it within the dado 68. Alternately, the recessed dado 68 and the projection could be shaped to snap together, thus eliminating fasteners altogether.

Preferably, the projection 76 is spaced from the bottom surface of the leg 73 so as to provide a slot 90 that extends along the length of the assembly. The slot 90 provides a receptacle for the mounting tab 91 of a length of weather stripping 89. When a closed door or side light window panel is installed against the weather stripping 89, the weather stripping provides a seal against drafts and cold. Furthermore, with the configuration of the projection 76, the weather stripping 89 covers and hides the heads of staples 77 so that they are not visible to an observer. This configuration provides the further advantage that the manufacturer does not have to countersink the fasteners and fill the holes to hide them from an observer.

The brickmold and stop member 69 is further configured to define a decorative brickmold portion 78 that projects beyond the plane of the outside face 67 of the jamb member 62. In use, the decorative brickmold portion 78 frames the door jamb assembly within a rough opening in which it is installed and overlaps the edge portion of the opening to provide a clean decorative framing. The decorative brickmold portion 78 has an exposed outer surface 79 and an inner surface 81. The inner surface 81 is formed to define a recess and an elongated stabilizer 82 is disposed within the recess extending along the length of the decorative brickmold portion 78. In the preferred embodiment, the stabilizer 82 comprises an elongated wooden board that is sized and configured to fit within the recess. However, the stabilizer might well be made of other suitable materials such as plastic or particle board. During manufacture, it has been found advantageous that the stabilizer 82 be installed by applying adhesive along its outside face and popping it into place within the recess 81 formed in the decorative brickmold portion 78. The stabilizer 82, once installed, stabilizes and strengthens the decorative brickmold portion 78 and also provides enhanced interfibrous holding capacity for a finishing nail 88 used to attached the assembly to the rough opening of the building. The stabilizer also reduces the amount of thermoplastic material that must be used when extruding the brickmold and stop member.

A relatively short elongated tab 83 is co-extruded with the brickmold and stop member 69 and is positioned and configured to extend along and cover a portion of the inside face 67 of the jamb member 62 along and adjacent its outside edge 64. Fasteners such as staples 84 can be driven through the tab 82 and into the jamb member 62 for securing the brickmold and stop member 69 to the jamb member 62. The combination of fasteners 77 and 84 have proven to be more than sufficient to hold the brickmold and stop member 69 securely and firmly to the jamb member 62 so that the two components form a strong unitary whole. Furthermore, attaching the brickmold and stop member 69 with staples as shown in FIG. 4 is readily adaptable to standard manufacturing techniques and allows assembly of door jamb and brickmold units quickly and easily during the manufacturing process.

The configuration shown in FIG. 4 is installed within a rough opening of a building structure in a method substantially the same as prior art milled wooden assemblies. Specifically, the door jamb assembly is inserted into the rough opening with the decorative brickmold portion 78 framing and covering the outside edges of the framing studs of the rough opening. The jamb assembly can then be leveled and squared with shims in the usual way, whereupon finishing nails 87 and 88 are driven through the jamb member 62 and the decorative brickmold 78 respectively to secure the assembly within the opening. In this regard, as mentioned above, the stabilizer 82 provides an excellent medium through which a finishing nail 88 can be driven and provides additional holding capacity for the nail after installation. Once installed and painted, the assembly of FIG. 4 presents an appearance virtually identical to that of a prior art milled all wooden assembly with the substantial advantages provided by the co-extruded thermoplastic brickmold and stop member.

Figure 5:
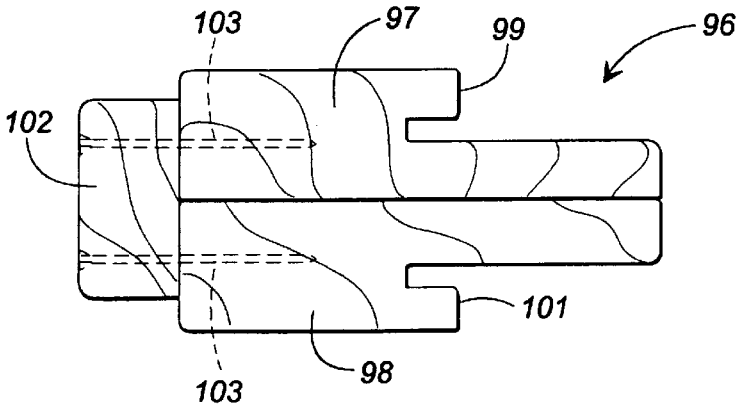
(PRIOR ART) FIG. 5
FIG. 5 is a cross-sectional view of a prior art wooden mullion used in side light door jamb assemblies.

FIGS. 5 through 9 illustrate application of the present invention to the mullioned sections of a side light door and jamb assembly. FIG. 5 illustrates a prior art milled wooden mullion assembly that has been used for many years. Such mullions are typically milled from thick wooden boards and comprise a first support member 97 and a second support member 98 arranged in back-to-back relationship. The first support member 97 is milled to define a raised stop 99 that abuts either the door or the side light window assembly, depending upon the side of the door on which the mullion resides. Similarly, the mullion support 98 is milled to define a raised stop 101 on the other side of the assembly.

Grooves are milled along the bottoms of the raised stops to receive the attachment tabs of weather stripping. To cover the junction between the two support members and to provide a pleasing aesthetic exterior appeal, a strip of molding 102 is nailed with finishing nails 103 along the front edges of the support members. The molding 102 can take a variety of decorative shapes but generally functions to cover and protect the junction, to keep water out of the junction, and to provide a decorative surface for paint or other finish. As mentioned above, such prior art mullion assemblies are expensive and labor intensive because of the milling processes that must be applied and are also subject to rot, deterioration, and vermin because of their wooden construction.

Figure 6:
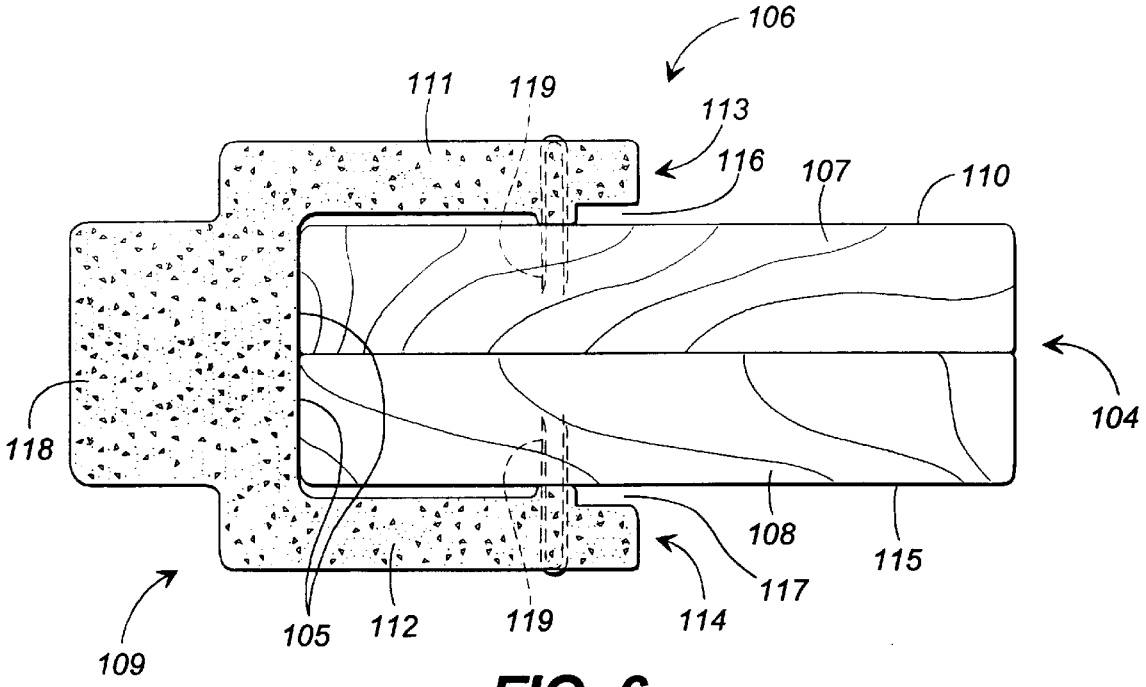
FIG. 6 is a cross-sectional view of a mullion assembly that embodies principles of the present invention in a preferred form.

FIG. 6 illustrates a mullion assembly that embodies principles of the present invention in a preferred form. The assembly 106 comprises a first mullion support member 107 and a second mullion support member 108. In the preferred embodiment, the mullion support members 107 and 108 comprise elongated relatively thin wooden boards that are arranged in back-to-back relationship. Alternatively, the mullion support members 107 and 108 could be spaced slightly from one another with spacers or the like to allow for leveling and squaring as a jamb and door assembly is installed in the opening of a building structure. The mullion support members 107 and 108 have inside edges 104 and outside edges 105. Support member 107 has an exposed face 110 and support member 108 has an exposed face 115.

An extruded thermoplastic molding and stop member 109 is co-extruded of an appropriate thermoplastic material and has a relatively less dense blown plastic core covered by a relatively more dense nonblown plastic skin. The molding and stop member 109 is formed to define a first leg 111 that overlies a portion of the exposed face 110 of the support member 107 and that extends approximately to the midsection thereof. Similarly, a second leg 112 overlies the exposed face 115 of the support member 108 and also extends approximately to the midsection thereof. The end 113 of the first leg 111 forms a raised stop relative to the exposed face 110 of the support member 107 and the end 114 of the leg 112 defines a similar raised stop relative to the exposed face 115 of the support member 108. Further, the end portion of the leg 111 is formed with a rabbit 116 that, in conjunction with the face 110, defines a slot that extends along the length of the mullion member. Rabbit 117 forms a similar slot that extends along the length of face 115 on the other side of the mullion assembly. Slots 116 and 117 are sized to receive the attaching tab of a length of weather stripping for sealing against a door or side light window frame installed against the mullion assembly.

Fasteners, such as staples 119, extend through the legs 111 and 112 and into the wooden structure of the mullion support members 107 and 108. In this way, the thermoplastic molding and stop member is firmly secured to the mullion supports to define the finished structure and shape of the assembly. The heads of the fasteners preferably are recessed into the surface of the molding and stop member and the resulting dimples can be filled with traditional fillers before painting. The substantially solid construction of the molding and stop member allows the use of staples, finishing nails, or any other common fastener that has heretofore been used in all wooden mullion assemblies. Thus, no special tools or fasteners required in the assembly of many prior art devices are required.

The molding and stop member 109 is further formed to define a decorative molding portion 118 that extends along the front of the assembly 109 and that is exposed on the outside of a building in which the jamb and door assembly is installed. In the embodiment of FIG. 6, the decorative molding portion 118 is shaped to mimic a typical mullion such as that shown in FIG. 5. It will be understood, however, that a variety of decorative shapes might be extruded into the decorative molding portion 118 to provide various appearances on the outside of the building. The relatively more dense outer skin of the molding and stop member 109 is selected to be easily primed and painted or, alternately, the outer skin can be dyed during the extrusion process to have a predetermined desired color and to avoid painting and related maintenance long into the future.

Figure 7:
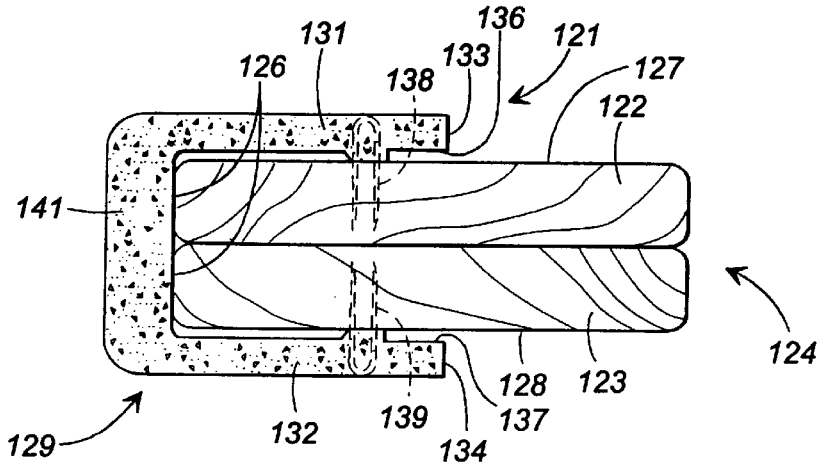
FIG. 7 is a cross-sectional view of a mullion that embodies principles of the present invention in another preferred form.
Figure 8:
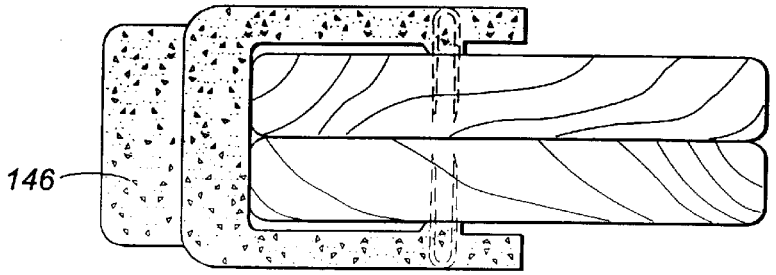
FIG. 8 is a cross-sectional view of a mullion that embodies principles of the present invention in yet another preferred form.

FIGS. 7 and 8 show alternate embodiments of the mullion assembly illustrated in FIG. 6. In FIG. 7, mullion supports 122 and 123 are arranged in back-to-back relationship. Support member 122 has an exposed face 127 and support member 123 has an exposed face 128. The support members 122 and 123 have inside edge portions 124 and outside edge portions 126. A generally U-shaped extruded thermoplastic molding and stop member 129 is fitted over the outside edge portions 126 of the mullion supports 122 and 123. The molding and stop member has a first leg 131 that overlies a portion of the face 127 of support member 122, and similarly, leg 132 overlies a portion of the face 128 of support member 123. Ends 133 and 134 of the legs 131 and 132 respectively form raised stops relative to the respective faces of support members 122 and 123. Rabbets 136 and 137 in conjunction with the faces 127 and 128 form slots that extend along the mullion member for receiving the attachment tab of weather stripping.

As with the embodiment of FIG. 6, the molding and stop member 129 is attached to the mullion supports with fasteners such as staples 138 and 139, which hold the thermoplastic molding and stop member securely to the mullion supports forming the finished mullion assembly. In the embodiment of FIG. 7, the decorative molding portion 141 of the molding and stop member is defined simply by the bight portion of the U-shaped member and no additional decorative molding portion is formed. This configuration might be used for simple door and jamb assemblies that are not to be festooned with decorative molding.

FIG. 8 illustrates an alternate embodiment of the mullion assembly of this invention wherein a separate extruded decorative molding portion 146 is attached to the outside of the byte portion of the molding and stop member with appropriate adhesive. In this embodiment, a standard molding and support member could be supplied with a wide variety of available decorative molding portions, which could be attached with adhesive during construction according to the instructions of particular customers.

Figure 9:
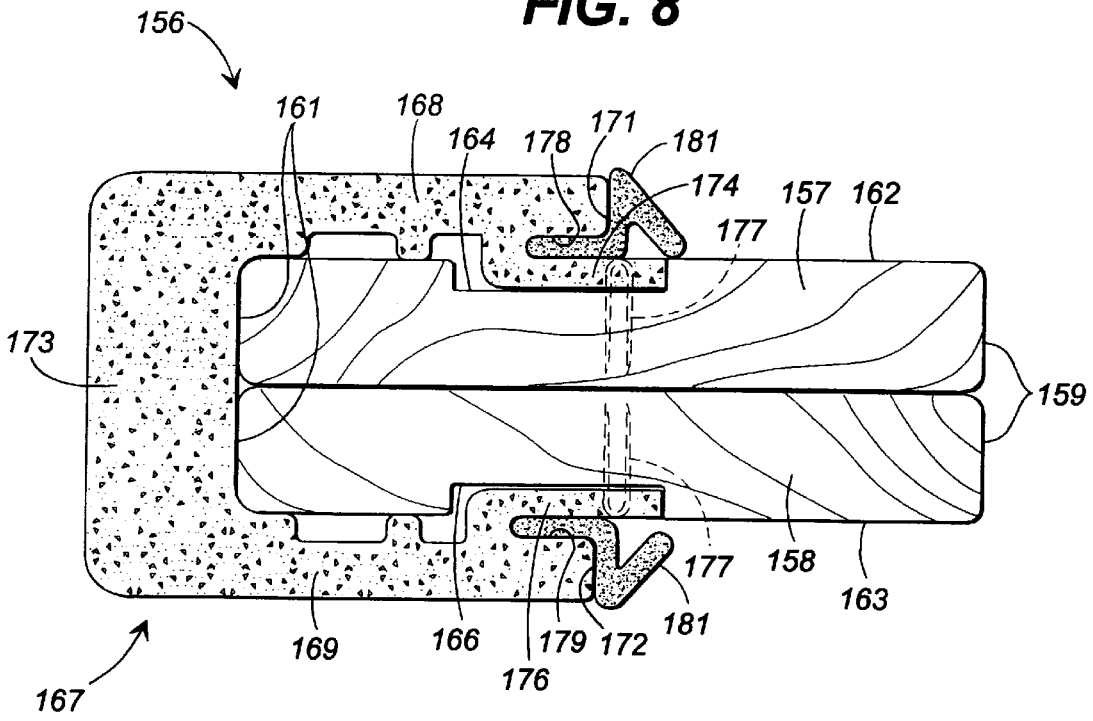
FIG. 9 is a cross-sectional view of a mullion that embodies principles of the present invention in still another preferred form.

FIG. 9 illustrates an alternate embodiment of the mullion assembly of the present invention. This embodiment comprises first and second mullion support members 157 and 158 respectively that, as with prior embodiments, are arranged in back-to-back relationship with opposed exposed faces 162 and 163. Exposed face 162 in this embodiment is formed with a recessed dado 164 that extends along the length of the support member 157. Similarly, face 163 is formed with a recessed dado 166 that extends along the length of support member 158. Support members 157 and 158 have inside edge portions 159 and outside edge portions 161.

A generally U-shaped molding and stop member 167 is co-extruded of thermoplastic material and has a relatively less dense thermoplastic core covered by a relatively more dense plastic skin. The molding and stop member 167 defines a first leg 168 that overlies a portion of the face 162 of support member 157 and extends approximately to the midsection thereof. The end 171 of the leg 168 defines a raised stop relative to the face 162 for abutting a door or side light window frame. A protrusion 174 extends beneath the leg 168 and protrudes a predetermined distance beyond the end 171 of the leg. The protrusion 174 is sized and positioned to be received within the recessed dado 164 with its outer surface substantially flush with the face 162 as shown. This configuration provides a tab through which fasteners such as staples 177 can be driven to secure the molding and stop member to the support members. A slot 178 is sized to receive the attaching tab of a length of weather stripping 181 and, when installed, the weather stripping covers the heads of the fasteners 177 so that countersinking and filling is not required.

Similarly, leg 169 overlies face 158 and extends approximately to the midsection of support member 158. The end 172 of the leg forms a raised stop relative to the face 163 and a protrusion 176 extends beneath the end portion of the leg and beyond the end 172. The protrusion 176, like protrusion 174, is sized and configured to be received in the recessed dado 166 with the outer surface of the protrusion being substantially coextensive with the face 163. Fasteners 177 can be driven through the protrusion 176 and into the support member 158 to secure the molding and stop member to the support members. Slot 179 receives the attaching tab of a length of weather stripping 181, which, when installed, covers the head of the staples 177.

A decorative molding portion 173 is defined by the molding and stop member 167 and extends along the front or exposed edge of the mullion assembly. In the embodiment of FIG. 9, the decorative molding portion 173 is a simple flat surface. However, the decorative molding portion 173 could be shaped to define any one of a number of decorative surfaces as desired. Alternatively, a separate strip of molding could be applied to the surface of the molding portion 173 with appropriate adhesive or other fastening means.

One advantage of the embodiment of FIG. 9 is that the molding and stop member 167 is firmly secured to the support members with staples 177 that can readily be applied with standard construction techniques and tools and that are covered with weather stripping in the final product so that the staples do not need to be countersunk and filled. This saves substantial time and money in the construction process and provides an aesthetically pleasing and strong final product.

Figure 10:
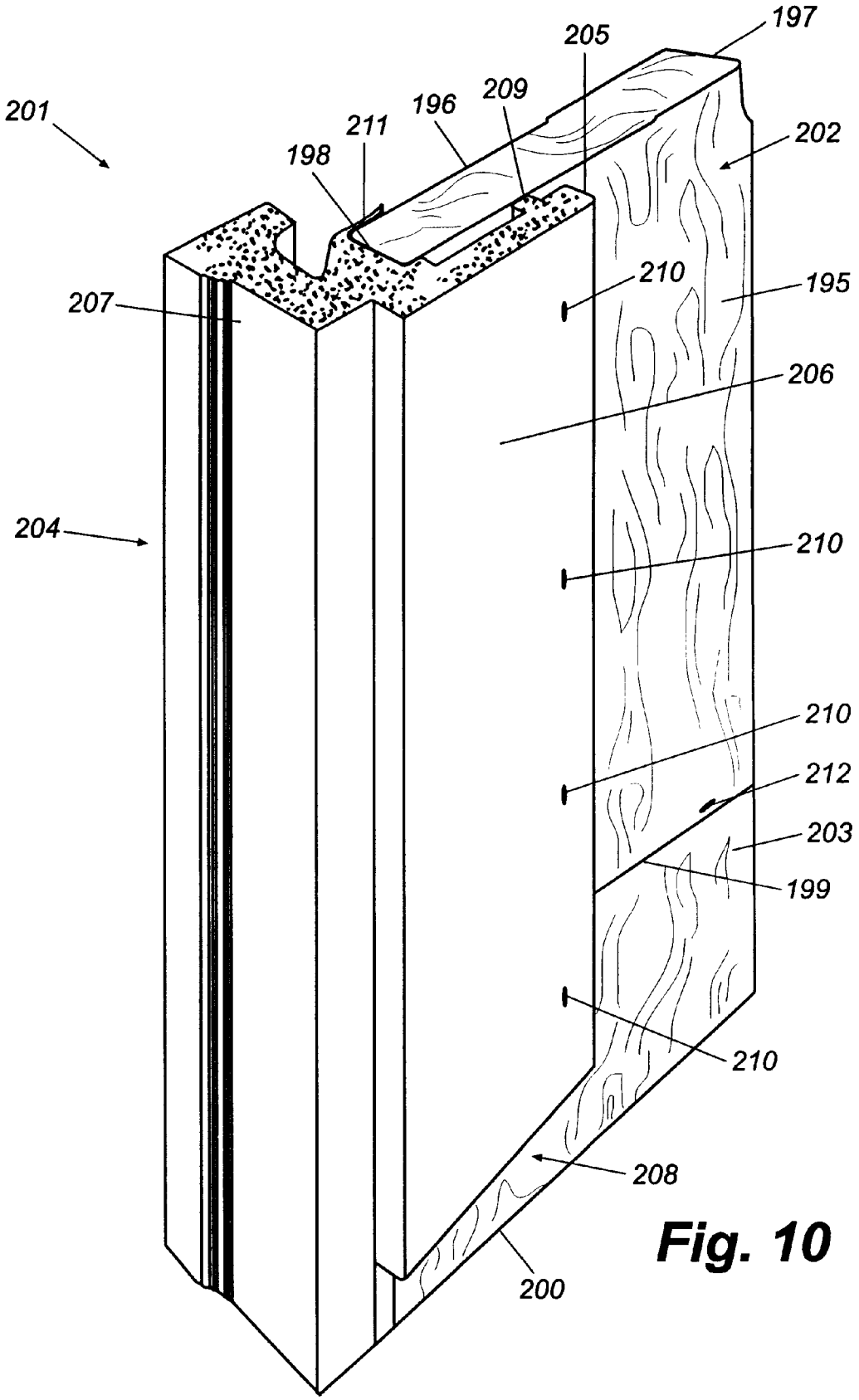
FIG. 10 is a perspective view of the bottom portion of a vertical jamb illustrating the plastic attachment and its reinforcement by the brickmold and stop member.
Figure 11:
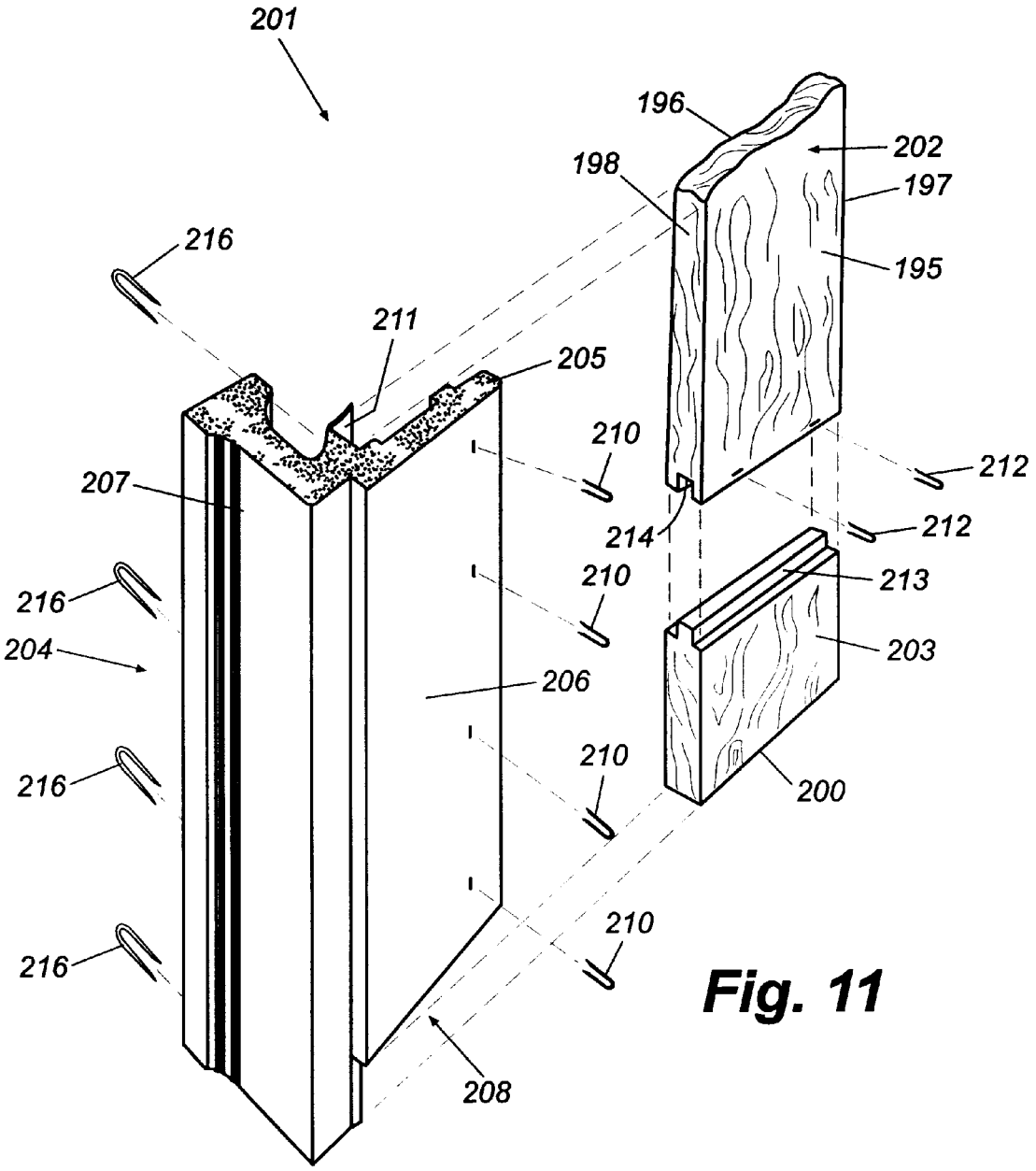
FIG. 11 is an exploded perspective view of the assembly of FIG. 10 illustrating the structural relationship between the components of the assembly.

FIGS. 10 through 13 illustrate another preferred embodiment of the present invention wherein portions of the vertical jambs that meet and are attached to a door sill and threshold assembly are formed entirely of extruded plastic material for durability and resistance to rot and deterioration. FIGS. 10 and 11 illustrate the bottom portion of a vertical jamb member 201 that embodies principles of the invention in an alternate form. It will be understood that the jamb member 201 in reality extends upwardly and meets at its top with a horizontal head jamb that forms the top of the door frame. The jamb member 201 is formed from a relatively thin flat wooden board 202 that has an inside face 195, an outside face 196, an inside edge 197, and an outside edge 198. An extruded thermoplastic extension 203 is joined at 199 to the bottom of the wooden board 202 and extends downwardly therefrom to a bottom end 200. The extension 203 has the same cross sectional shape as the wooden board 202 and, in the illustrated embodiment, is formed with an upwardly projecting tongue 213 that is received in a corresponding groove 214 formed in the bottom of the wooden board 202. The extension 203 is mounted to the bottom of the board 202 by inserting the tongue 213 into the groove 214 and driving staples 212 through the resulting joint. Alternatively, the two pieces could be joined together with adhesive or any other suitable fastening method or device. Together the board 202 and coextensive extension 203 form an elongated relatively narrow support member of the door jamb assembly.

A substantially solid extruded plastic stop and brickmold member 204 is secured to the support member and extends generally along the outside edge 198 thereof. The stop and brickmold member is coextruded from appropriate thermoplastic material and has a relatively less dense blown plastic core covered by a relatively more dense nonblown plastic skin, the stop and brickmold member 204 is configured to define a leg 206 that overlies a portion of the inside face 195 of the support member and that defines a raised stop 205 against which a closed door mounted in the door frame assembly rests. The leg 206 spans the joint 199 between the wooden board 202 and the plastic extension 203 and has a bottom portion 208 that is contoured to receive and be mounted to the end of a door sill assembly in the traditional way.

The stop and brickmold member 204 of the illustrated embodiment is further configured to define a decorative brickmold 207 as described above relative to other embodiments. It should be understood, however, that the decorative brickmold need not necessarily be a part of the member 204. It could be left off altogether and a traditional wooden brickmold provided or a separate extruded plastic brickmold could be attached with adhesive or fasteners if desired. A hard but slightly flexible plastic tab 211 is coextruded with the stop and brickmold member 204 and is sized and positioned to overlap partially the forward edge portion of the outside face 196 of the board 202. Further, as with the leg 206, the tab 211 spans the joint between the board 202 and the extension 203 on the outside of the support member formed thereby.

The stop and brickmold assembly 204 is securely fastened to the support member formed by the board 202 and extension 203 by means of a first array of staples 210 driven through the leg 206 and into the inside surface of the support member and a second array of staples 216 driven through the tab 211 and into the outside surface of the support member. It is significant that the staples 210 and 216 be driven both into the wooden board 202 of the support member and into the plastic extension 203 that forms the bottom end of the support member. It has been found that the spanning of the joint 199 by the stop and brickmold member 204 and the attachment with staples extending both into the wooden board 202 and plastic extension 203 greatly reinforces the inherently weak joint between the wooden board 202 and plastic extension 203 forming a rigid monolithic structure that is very strong and able to withstand even the most extreme stresses during handling and installation of the door jamb assembly. While staples have been illustrated as a preferred method of attaching the stop and brickmold member, it will be understood that any suitable attachment mechanism such as, for example, adhesive or nails might be substituted and that such would be equivalent to the illustrated staples.

With the just described construction, it will be understood that a vertical door jamb member is now provided wherein the entire bottom end of the jamb member is formed of extruded cellular plastic material. Therefore, when the jamb is secured at its bottom end to a door sill, all of the surfaces that are traditionally exposed to water that runs down onto the door sill are made of non-wooden material. As a result, rot and deterioration at the bottom of the jamb due to wicked moisture is eliminated. The composite jamb of this embodiment is thus superior and solves some of the problems of the prior art.

Figure 12:
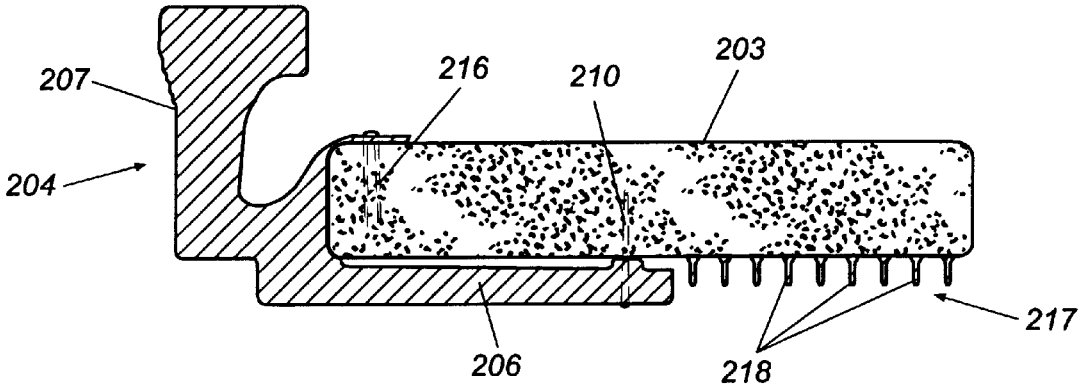
FIG. 12 is a cross sectional view of the bottom section of a vertical jamb of this invention illustrating one embodiment of a bottom seal formed by flexible fins coextruded with the plastic bottom attachment.
Figure 13:
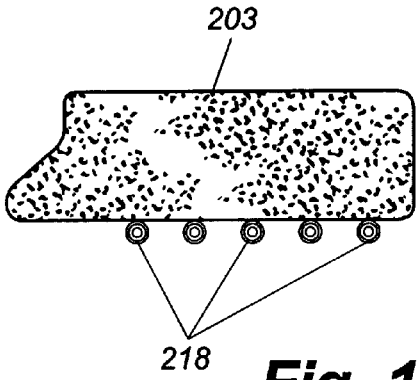
FIG. 13 is a cross sectional view illustrating an alternate embodiment of the coextruded bottom seal.

FIGS. 12 and 13 illustrate an embodiment of the invention illustrated in FIGS. 10 and 11 wherein a bottom seal is coextruded with the extension 203 to form a seal against the bottom outside edge portion of a closed door. FIG. 12 is a cross section through the plastic extension 203 of FIGS. 10 and 11 and shows the stop and brickmold assembly 204 attached by means of staples 210 and 216. An array 217 of flexible fins 218 are coextruded with the extension 203 and project outwardly therefrom to engage and bear against a closed door mounted in the jamb. The fins thus form a seal at the bottom corner of the door adjacent the door sill that prevents water from being blown or otherwise driven through the space between the extension and the door, as can sometimes happen in driving or windblown rains. FIG. 13 shows an alternate embodiment of such a seal wherein an array of elongated flexible bulbs 218 are coextruded on the extension 203. The bulbs 218 are compressed between the extension 203 and the bottom portion of the door edge when the door is closed to form a seal that prevents the migration of water in blowing rains.

The invention has been described herein in terms of preferred embodiments. It will be obvious to those of skill in the art, however, that a variety of configurations not illustrated herein might well be implemented within the scope of the invention. For example, the shapes of the projections forming the attachment tabs in the present invention have been illustrated to be simply rectangular. However, a wide variety of shapes might be selected for the protrusions as well as the recessed dados for receiving them. Further, staples have been illustrated as the preferred attachment means for attaching the extruded thermoplastic portions to the wooden portions. Obviously, any suitable attachment means might be used such as, without limitation, nails, adhesive, or brads. Further, separate fasteners might be avoided altogether by forming the extruded thermoplastic portions of the invention with attaching projections that have a snapping tongue or that perform a snapping action within appropriately configured dado grooves formed in the faces of the wooden portions. While such a configuration might be less secure than the preferred fastening means, it would nevertheless provide for quick construction since the molding and stop members could simply be snapped into place on the wooden support members. In addition, the stop and brickmold member has been illustrated in the preferred embodiments as being a unitary extruded plastic piece. It will be obvious to those of skill in the art, however, that the stop portion and the brickmold portion could be separate pieces secured together with nails, staples, or adhesive and that such a configuration would be equivalent to the single extrusion shown in the preferred embodiments. Finally, the preferred embodiments have been illustrated with substantially solid co-extruded thermoplastic molding and stop members having relatively less dense blown cores and relatively more dense skins. While this is preferred for a variety of reasons, the plastic components could just as well be formed of solid nonblown plastic, recycled plastic, or other appropriate materials. It is advantageous, however, that the thermoplastic portions be substantially solid so as to be able to receive and hold nails, staples, and other common fasteners used in the construction industry. These and a wide variety of other additions, deletions, and modifications might well be made to the illustrated embodiments without departing from the spirit and scope of the invention as set forth in the claims.

What is claimed is:

1. A jamb assembly comprising;

an elongated support member having an inside face, an outside face, an inside edge, and an outside edge;

said support member having an upper section formed of wood and a lower section joined to and extending downwardly from said upper section to a bottom end of said support member, said lower section being fabricated from a non wooden rot resistant material; and a stop member mounted to and extending along the length of said support member, said stop member being formed with a leg that overlies a portion of said inside face of said support member and that forms a raised stop relative to said inside face for abutting a closed door;

said stop member spanning the joint between said wooden upper section of said support member and said non wooden lower section to reinforce the joint to form a rigid monolithic structure.

2. A jamb assembly as claimed in claim 1 and wherein said lower section is formed of plastic.

3. A jamb assembly as claimed in claim 2 and wherein said lower section is formed of extruded plastic having a relatively less dense blown core and a relatively more dense non blown skin.

4. A jamb assembly as claimed in claim 1 and wherein said stop member is formed of an extruded plastic material having a relatively less dense blown core and a relatively more dense non blown skin.

5. A jamb assembly as claimed in claim 4 and further comprising a decorative brickmold mounted to and extending along said stop member.

6. A jamb assembly as claimed in claim 5 and wherein said decorative brickmold is coextruded with said stop member.

7. A jamb assembly as claimed in claim 5 and wherein said decorative brickmold is mounted to said stop member.

8. In a jamb member having an elongated support member and a stop member mounted to and extending along said support member, the improvement comprising a deterioration resistant extension joined to and forming the bottom portion of said support member for resisting rot and decay caused by moisture, said support member having upper portion and wherein a joint is defined between said upper portion and said extension, said stop member spanning said joint and being fixed to said upper portion and to said extension to reinforce and strengthen said joint.

9. The improvement of claim 8 and wherein said extension is formed of extruded plastic having a relatively less dense blow core covered by a relatively more dense non blown skin.

10. The improvement of claim 9 and wherein said stop member is formed of extruded plastic having a relatively less dense blown core and covered by a relatively more dense plastic skin.

11. The improvement of claim 10 and wherein said stop member is fastened to said support member by staples.

12. The improvement of claim 8 and further comprising means on said extension for sealing against a closed door.

13. The improvement of claim 12 and wherein said said extension is formed of extruded plastic and wherein said means for sealing comprises an array of flexible fins coextruded with and projecting from said extension.

14. The improvement of claim 12 wherein said extension is formed of extruded plastic and wherein said means for sealing comprises an array of flexibly bulbs coextruded with and projecting from said extension.

15. A door jamb assembly having an upper portion and a lower portion, said lower portion being formed of a decay resistant plastic material, and means forming a seal between said lower portion and the bottom inside edge of a closed door to prevent migration of moisture into a building structure.

16. A door jamb assembly as claimed in claim 15 and wherein said means forming a seal comprises an array of flexible fins projecting from said lower portion.

17. A door jamb assembly as claimed in claim 15 and wherein said means forming a seal comprises an array of flexible protrusions formed on said lower portion.

* * * * *